US005742314A

United States Patent [19]

Hayes

[11] Patent Number: 5,742,314

[45] Date of Patent: Apr. 21, 1998

[54] INK JET PRINTHEAD WITH BUILT IN FILTER STRUCTURE

[75] Inventor: Donald J. Hayes, Plano, Tex.

[73] Assignee: Compaq Computer Corporation, Houston, Tex.

[21] Appl. No.: 220,835

[22] Filed: Mar. 31, 1994

[51] Int. Cl.[6] ..... B41J 2/175

[52] U.S. Cl. ..... 347/93; 347/69; 205/68

[58] Field of Search ..... 347/68, 71, 88, 347/93, 92, 20, 67; 210/498, 499, 500.1, 500.25, 500.26, 500.22; 205/75, 68, 122, 127, 67

[56] References Cited

U.S. PATENT DOCUMENTS

| | | | |
|---|---|---|---|
| 4,380,770 | 4/1983 | Maruyama | 347/92 |
| 4,514,743 | 4/1985 | Roschlein et al. | 347/68 |
| 4,887,100 | 12/1989 | Michaelis et al. | 347/69 |
| 5,105,209 | 4/1992 | Koto et al. | 347/88 |
| 5,154,815 | 10/1992 | O'Neill | 205/75 |
| 5,204,690 | 4/1993 | Lorenze, Jr. et al. | 347/93 |
| 5,227,813 | 7/1993 | Pies et al. | 347/71 |
| 5,234,594 | 8/1993 | Tonucci et al. | 210/500.26 |
| 5,446,484 | 8/1995 | Hoisington et al. | 347/68 |
| 5,465,108 | 11/1995 | Fujimoto | 347/68 |

FOREIGN PATENT DOCUMENTS

| | | | |
|---|---|---|---|
| 0215595 | 3/1987 | European Pat. Off. | B41J 3/04 |
| 0382423 | 8/1990 | European Pat. Off. | B41J 2/175 |
| 58-208062 | 12/1983 | Japan | 347/88 |
| 59-159356 | 9/1984 | Japan | B41J 3/04 |
| 60-262653 | 12/1985 | Japan | 347/93 |
| 61-173949 | 8/1986 | Japan | B41J 3/04 |
| 61-188160 | 8/1986 | Japan | B41J 3/04 |
| 3-234542 | 10/1991 | Japan | 347/93 |
| 4099634 | 3/1992 | Japan | B41J 2/045 |
| 4-329142 | 11/1992 | Japan | 347/88 |

*Primary Examiner*—Benjamin R. Fuller
*Assistant Examiner*—Charlene Dickens
*Attorney, Agent, or Firm*—Vinson & Elkins L.L.P.

[57] ABSTRACT

An ink jet printhead body has an ink filter structure integrally incorporated therein and operative to filter ink flowing into its internal ink receiving channels disposed between piezoelectrically deflectable interior wall portions of the body. In various illustrated embodiments of the printhead, the filter structure is defined by a series of photoetched micro filter passageways formed integrally in an outer side portion of the printhead body, a filter cavity formed in the outer side portion and receiving a separate photoetchable filter member in which photoetched micro filter passageways are formed, and a filter cavity formed in the outer side portion and receiving a separate mesh-type micro filter member. In an embodiment of the printhead adapted for use with phase change type ink, a heating channel is interiorly disposed within the outer body side portion and operatively receives an electrical resistance heating wire used to heat phase change type ink disposed within the ink receiving channels in the printhead body.

27 Claims, 3 Drawing Sheets

INK JET PRINTHEAD WITH BUILT IN FILTER STRUCTURE

BACKGROUND OF THE INVENTION

1. Field of the Invention

The present invention relates to an ink jet printhead apparatus and more particularly to an apparatus having a filter structure contained within the printhead for filtering ink or having a heating structure contained within the printhead for heating phase change ink.

2. Description of Related Art

A piezoelectrically actuated ink jet printhead is a relatively small device used to selectively eject tiny ink droplets onto a paper sheet operatively fed through a printer, in which the printhead is incorporated, to thereby form from the ejected ink droplets selected text or graphics on the sheet. The printhead typically has an end plate with very small orifices through which the ink is ejected onto the paper in a precise manner. Due to the small size of these openings, it is imperative that the ink be filtered prior to being ejected to remove any large foreign particulate matter that might clog the channels and openings of the tiny orifices and thereby prevent the ink from being ejected from the printhead in an efficient and effective manner. In one representative configuration thereof, a filter is positioned outside of the printhead between a separate external ink supply source and the printhead. In such configurations, the ink passes from the ink supply source through the filter and into the printhead where it is ejected onto the paper. In another configuration, the ink supply source, the printhead and the filter are all integrally formed into one unit. When the ink supply has been exhausted, the entire unit is then thrown away.

In another configuration, phase change ink is used. This ink is typically solid at room temperature. As such, it is necessary that it be heated above room temperature before it will flow effectively from the supply source to and through the small ink passages within the printhead. Generally, in those configurations where the ink supply and the printhead are separate units, the ink is heated by an external heating apparatus on both the ink supply source and the printhead. The phase change ink is heated sufficiently to achieve a liquefied ink that will easily flow through the entire printhead ink distribution system. After the ink has been sufficiently heated at the supply source, the ink is transferred from the supply source through a filter and to the printhead that is heated by an external heating apparatus. The heated printhead maintains the ink's liquidity so that it will flow freely though the small printhead channels and orifices. The ink is then ejected from the printhead onto the paper. In those configurations where the ink supply source, the filter and the printhead are all one unit, the entire unit is heated by an external heating apparatus.

While the configurations just described are effective in producing high quality text and graphics, there are several disadvantages associated with these configurations. In the configurations where the filter is externally positioned between the separate ink supply and printhead, the filter is individually manufactured apart from the printhead and ink supply units. Once manufactured, the filter must then be properly positioned between the ink supply and the printhead. These steps not only increase the manufacturing time and cost, but it also requires more space within the printing apparatus. Further, the filter is more susceptible to external damage because it is suspended between the ink supply and the printhead by a tube, or, the tube may shift, thereby shifting the position of the filter, which may cause the filter to function less effectively. Additionally, the filter cannot be positioned as far down line of the ink flow as possible. This positioning may affect the way in which the ink is filtered. For instance, after leaving the filter, the ink traverses additional tube length before entering the narrow channels of the printhead. While passing through this additional tube length, the ink may pick up foreign matter that might clog the printhead. This configuration is also not as compact as possible. The additional distance existing between the ink supply, the filter and the printhead all require space that diminishes the compactness of the printing apparatus.

A disadvantage associated with the configuration where the ink supply, the filter and the printhead are all one unit, is the added expense arising from the manufacturing of separate components and the assembly of those individual components into a single unit. Another disadvantage is the premature disposal of the printhead and filter. When the ink supply is exhausted, the entire unit, including the printhead and the filter, are thrown away. This premature disposal of the printhead and filter is a waste of resources and is more costly for the consumer as well because the cost of the new filter and printhead is incorporated into the next ink supply unit that is purchased.

There are also disadvantages associated with those configurations where the phase ink is heated externally both at the ink supply source and the printhead. In conventional printhead heating systems, the heating element is located on the outside of the printhead. Thus, when the printhead is heated, enough energy must be applied to heat the internal ink distribution passageways of the printhead from the outside; this substantial disadvantage of conventional configurations requires more energy. Furthermore, the addition of the heating apparatus to the outside of the printhead requires an additional manufacturing step which increases the time and cost of manufacturing the heated printhead. Additionally, since the heating apparatus is positioned on the exterior of the printhead, it is more susceptible to damage.

It can be readily seen from the foregoing that it would be desirable to provide an improved ink jet printhead that eliminates, or at least substantially reduces, the above-mentioned disadvantages associated with the conventional printheads described above.

SUMMARY OF THE INVENTION

In carrying out principles of the present invention, in accordance with a preferred embodiment thereof, there is provided a printhead body having first and second outer surfaces with an ink filter means recessed in the first outer side surface. The filter means may be communicated with the external ink supply source through an ink conduit extending between the ink filter means and the external ink supply source. An ink manifold cavity formed within the interior of the body is in fluid communication with the ink filter means. An orifice plate that has a spaced series of ink discharge orifices extends rearwardly through the plate and is secured by an adhesive to the second outer side surface.

The ink discharge orifices extend rearwardly through the orifice plate to a spaced series of internal ink receiving channels disposed within the body and interdigitated with a spaced, parallel series of internal piezoelectrically deflectable sidewall sections extending rearwardly through the printhead body. The ink receiving channels extend between the ink manifold cavity and the discharge orifices.

Positioned on the first outer surface is a cover section that is sealingly secured by an adhesive to the first outer surface. The cover is positioned over the ink filter means to thereby seal the filter means within the interior of the printhead body. The cover has a conduit member positioned therein that is in fluid communication with the ink filter structure for receiving ink from the ink conduit.

In another embodiment, the body is comprised of a parallel intersecured generally plate-like top, bottom and intermediate sections with each section having a top side surface, a bottom side surface and aligned front edge surfaces. The ink filter means may be a plurality of vertically extending, horizontally space photoetched micro filter passageways that are formed in and extend through the top section. Alternatively, the filter means may be comprised of a filter cavity for receiving a separate removable filter structure therein. Preferably, the filter structure is comprised of a photosensitive etchable glass material having a plurality of photoetched micro filter passageways formed therein. However, the separate filter structure may also be a mesh-type micro filter member.

In yet another embodiment, the printhead body includes heating means that are disposed within the interior of the printhead body. The heating means comprise a heating channel formed in either the bottom surface of the top section or the top surface of the first intermediate section and an electrical resistance heating wire that is positioned within the heating channel. Preferably, the selected body section in which the channel is formed is a photosensitive etchable glass material and the channel is photoetched in the desired body section. In another aspect of this particular embodiment, the filter means are positioned externally to the printhead with the heating means formed within the printhead body.

DETAILED DESCRIPTION

Figure 1:
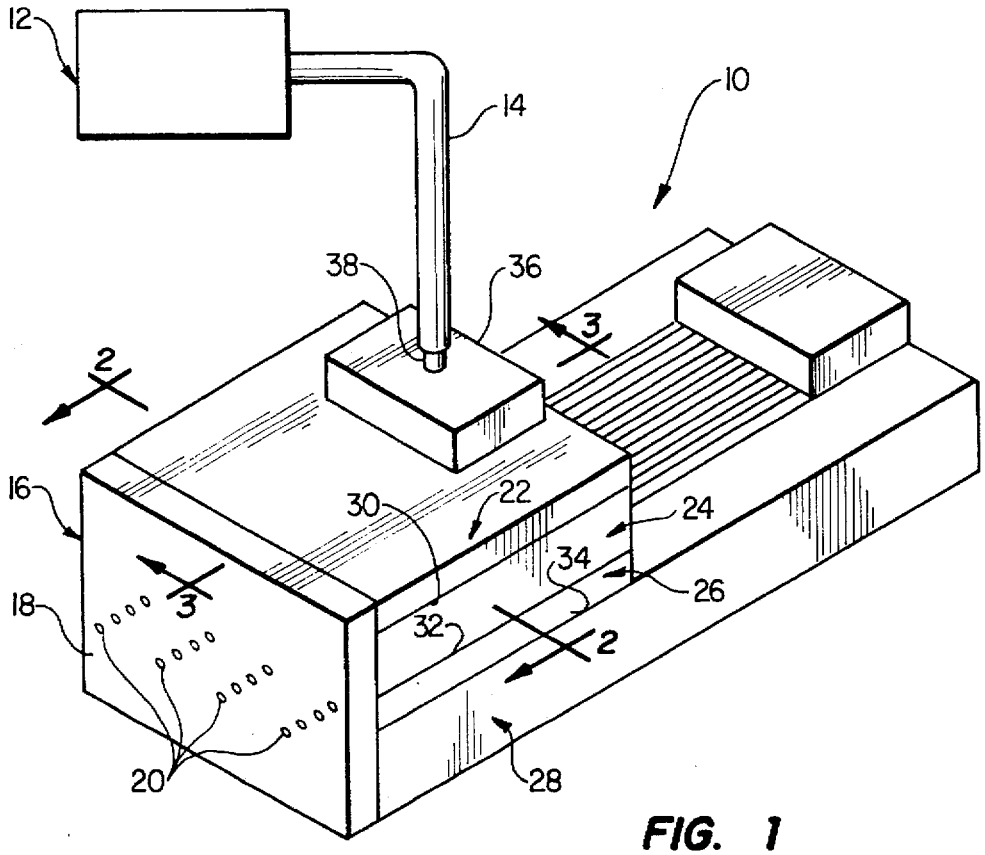
FIG. 1 is a perspective view of an ink jet printhead embodying principles of the present invention.

Referring initially to FIG. 1, the present invention provides an ink jet printhead 10 interconnectable to an separate external ink supply reservoir 12 by an ink conduit 14. A front end section 16 of the printhead 10, which is preferably formed from a nonpiezoelectric ceramic material, is defined by a horizontally elongated rectangular orifice plate 18. Extending rearwardly through the orifice plate 18 are a horizontally spaced series of small ink discharge orifices 20.

Secured to the rear side of the orifice plate 18, and extending rearwardly therefrom, are four intersecured body sections, each of a rectangular configuration, a top section 22, a first vertically intermediate section 24, a second vertically intermediate section 26, and a bottom section 28. The first and second vertically intermediate sections 24 and 26 are sandwiched between the top and bottom sections 22 and 28. The top section 22 and the first intermediate section 24 meet along a side surface juncture area 30 and are secured together by an adhesive 72 (see FIG. 3). The first intermediate section and the second intermediate section meet and are secured together by an adhesive along a side surface juncture area 32, while the second intermediate section 26 and the bottom section 28 meet and are secured together by an adhesive along a side surface juncture area 34. Secured to the top side of the top section 22 is a cover section 36 with a conduit member 38 extending upwardly therefrom. Removably attached to the conduit member 38 is the ink conduit 14 for conducting fluid from the external ink supply reservoir 12 to the printhead 10.

The top, first intermediate and bottom body sections 22, 24 and 28 are preferably formed from a nonpolled ceramic material. The top section 22 is preferably formed from a photosensitive etchable glass which is a silicate glass produced by adding a metallic ion and sensitizer. When exposed to ultraviolet rays, the photosensitive glass produces a metal colloid through heat development treatment, the nucleus of which develops into crystals. The crystals, which are extremely fine, are easily dissolved by an acid such as hydrofluoric acid. An example of a suitable photosensitive etchable glass that is commercially available is the photosensitive glass manufactured by Corning. Preferably, the second vertically intermediate section 26 is formed from a piezoelectrically active ceramic material.

Figure 2:
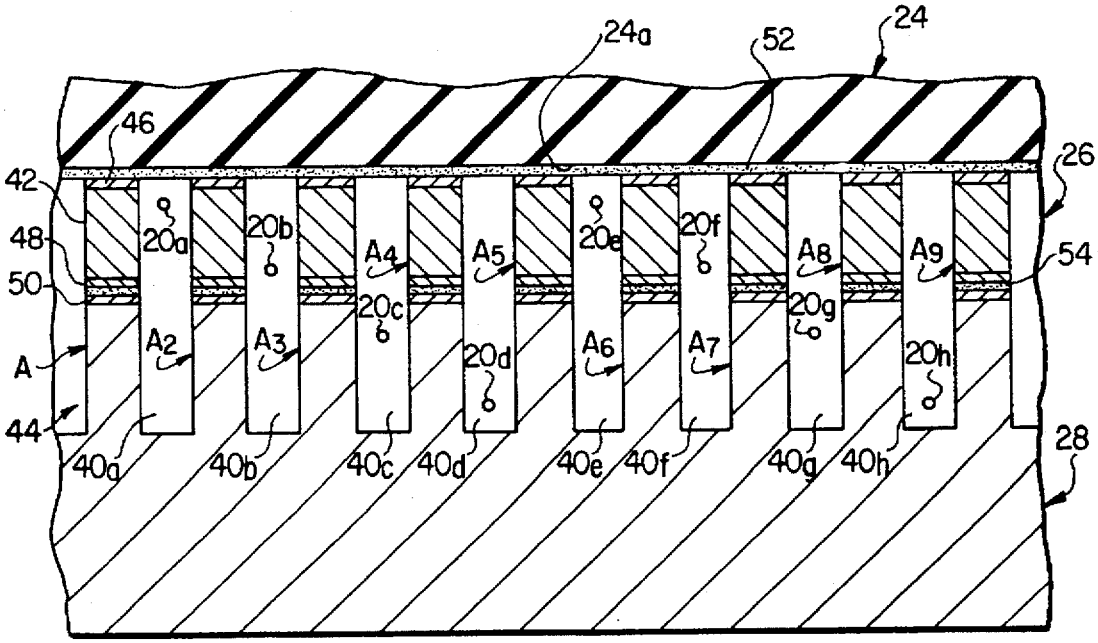
FIG. 2 is an enlarged scale partial cross-section view through the printhead taken along line 2—2 of FIG. 1.

Turning now to FIG. 2, a plurality of vertical grooves of predetermined width and depth are formed in the second intermediate and bottom sections 26 and 28 of the printhead body to define within the printhead 10 a spaced, parallel series of internal ink receiving channels 40 that longitudinally extend rearwardly from the orifice plate 18, with the front end of each of the channels opening outwardly through one of the ink discharge orifices 20. A representative group of channels **40*a*–40*h* is shown in the printhead portion cross-sectionally depicted in FIG. 2**.

The channels 40 are laterally bounded along their lengths by opposed pairs of series of internal actuator sidewall sections A of the printhead body interdigitated with the channels. A representative group of sidewall actuator sections $A_1$–$A_9$ are shown in the printhead body portion cross-sectionally depicted in FIG. 2.

The sidewall sections A have upper parts 42 defined by horizontally separated vertical portions of the second intermediate body section 26, and lower parts 44 defined by horizontally separated portions of the bottom section 28. The top and bottom sides of the actuator sidewall section parts 42, and the top sides of the actuator sidewall section parts 44 are respectively coated with electrically conductive metal layers 46, 48, and 50. Sections 24 and 26 are secured to one another by a layer of an insulative adhesive material 52 positioned between lower side surface **24*a* of the section 24 and the conductive metal layer 46. Sections 26 and 28, on the other hand, are secured to one another by a layer of electrically conductive adhesive material 54 positioned between the metal layers 48 and 50**.

The illustrated layer group of metal and electrically conductive adhesive form vertically separated top and bottom electrical connection portions on each of the actuators A. The top electrical connection portions defined by the metal layers 46 are arrayed generally along the section juncture area 32, and the bottom electrical connection portions (defined by the metal layers 48, 50) and the adhesive layer 54 are arrayed generally along the section juncture area 34.

Each of the channels 40 is filled with ink received from a suitable external ink supply reservoir 12 (see FIG. 1) connected to the channels via an ink conduit 14 communicating with the channels via an ink supply manifold cavity 78 (see FIG. 3) disposed within the printhead body 10 and coupled to rear end portions of the internal channels 40. During operation of the printhead, each horizontally opposed pair of the actuators A are piezoelectrically deflectable into the channel 40 that they laterally bound to force a quantity of ink disposed in the channel outwardly, in droplet form, through its associated orifice.

Figure 3:
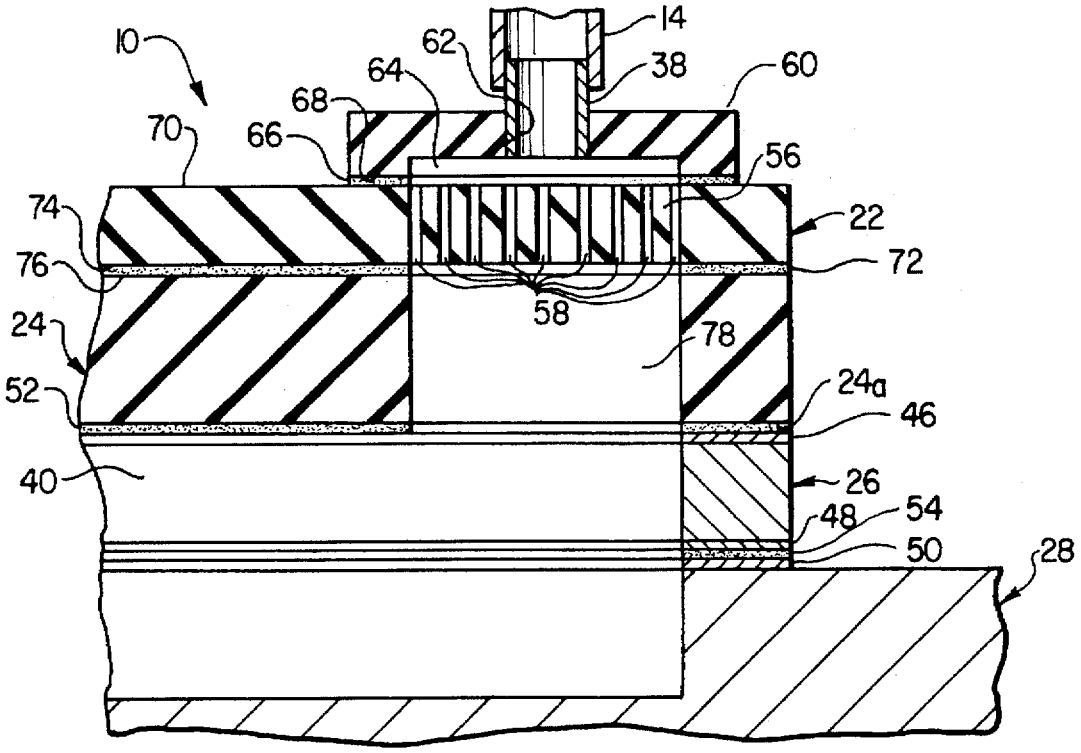
FIG. 3 is an enlarged scale partial cross-section view through the printhead taken along line 3—3 of FIG. 1 showing an etched filter within the printhead that is in communication with the ink reservoir supply tube and the ink fluid channel that is in communication with the orifice channels.

FIG. 3 illustrates a unique aspect of the present invention wherein the printhead has an internally positioned filter structure. As illustrated in FIG. 3, the printhead 10 has an internal filter structure section 56 comprising a plurality of vertically extending, horizontally spaced micro filter passageways 58 that have an axial orientation with respect to the ink flow received from the conduit member 38. The micro filter passageways 58 are integrally formed in the top section 22 and extend through the thickness of the top section 22. Sealingly secured to the top side of body section 22 and covering the micro filter passageways 58 is a cover section 60 having an opening 62 therein. Positioned within the opening is the previously mentioned 38 that is attachable to the ink conduit 14. The cover section 60 and the top section 22 are secured to one another by a layer of adhesive material 66 positioned between the bottom side surface 68 of the cover plate 60 and the top side surface 70 of the top section 22. A recessed area 64 may be formed within the bottom side surface 68 of cover plate 60 to allow for a uniform distribution of the ink through the micro filter passageways 58.

The micro filter passageways 58 are in fluid communication with the ink conduit 14 through the cover section conduit member 38. In communication with the micro filter passageways 58 is the previously mentioned ink supply manifold cavity 78. As illustrated in FIG. 3, the ink supply manifold cavity 78 communicates with the ink discharge orifices by way of the internal ink receiving channels 40 formed in the second intermediate and bottom section portions 26 and 28. As ink passes from the ink supply reservoir 12 and through the ink conduit 14 into the printhead 10, the micro sized passageways 58 screen the ink of foreign particulate matter, thereby preventing that foreign matter from entering and clogging the ink discharge orifices.

This unique internal filter structure section 56 offers several advantages over previous printhead devices. First, the filter structure 56 is fixed and is not susceptible to external damage or shifting. Second, since the internal printhead filter is separate from the ink supply reservoir, the filter is not disposed of when the ink supply is exhausted. This aspect of the present invention allows the filter and the printhead to be used for a longer period of time, thereby obtaining the maximum benefit and use from both the printhead and the filter. Third, since the filter is integrally formed within the top section 22, the filter portion of the printhead can be manufactured and assembled in a more efficient and cost effective manner. Fourth, the filter is positioned within the printhead 10 and, therefore is in closer proximity to the ink discharge orifices 20 which allows for a more effective filtering of the ink just prior to the time it enters the ink receiving channels 40. Fifth, the presence of the filter structure 56 provides a more compact printing apparatus that reduces space requirement within the printing apparatus.

The micro filter passageways 58 may be integrally formed in the material comprising the top section 22 by a material removal process, such as laser ablation or photoetching, or by a material addition process, such as electroforming. Preferably, however, the material removal process is a photoetching process that will be described later in this application. The ink manifold cavity 78, the ink receiving delivery channels 40 and the discharge orifices 20 may be formed by these same ablation processes or by other suitable means, if so desired.

In one embodiment of the present invention, the top section 22 is comprised of a photosensitive etchable glass material. In this particular embodiment the micro filter passageways 58 are formed in the top section 22 by a photoetching process. In another embodiment, the top section 22 is comprised of an ablatable material wherein the micro filter passageways 58 are formed by a laser ablation process, such as using an excimer laser process. Alternately, an ion beam material removal process could be used.

In the photoetching process, a photomask that exposes only the areas where the passageways are desired is made and placed on the photosensitive etchable glass. Afterwards, the masked glass is exposed to ultraviolet rays. The masked photosensitive glass is then subject to heat treatment that causes crystallization to occur in the unmasked portions of the glass. A suitable etching acid, such as hydrofluoric acid, is then applied to the crystallized portions of the glass. The acid dissolves the crystallized portions of the glass at a much higher rate than the base glass, thereby forming the passageways of the filter. After formation of the passageways, the glass is then subjected to a second heat treatment that transforms the glass into a permanent ceramic material that is no longer susceptible to ultraviolet rays. It should be noted, however, that the glass material would still be suitable for use as a filter without the aforedescribed second heat treatment process.

Figure 4:
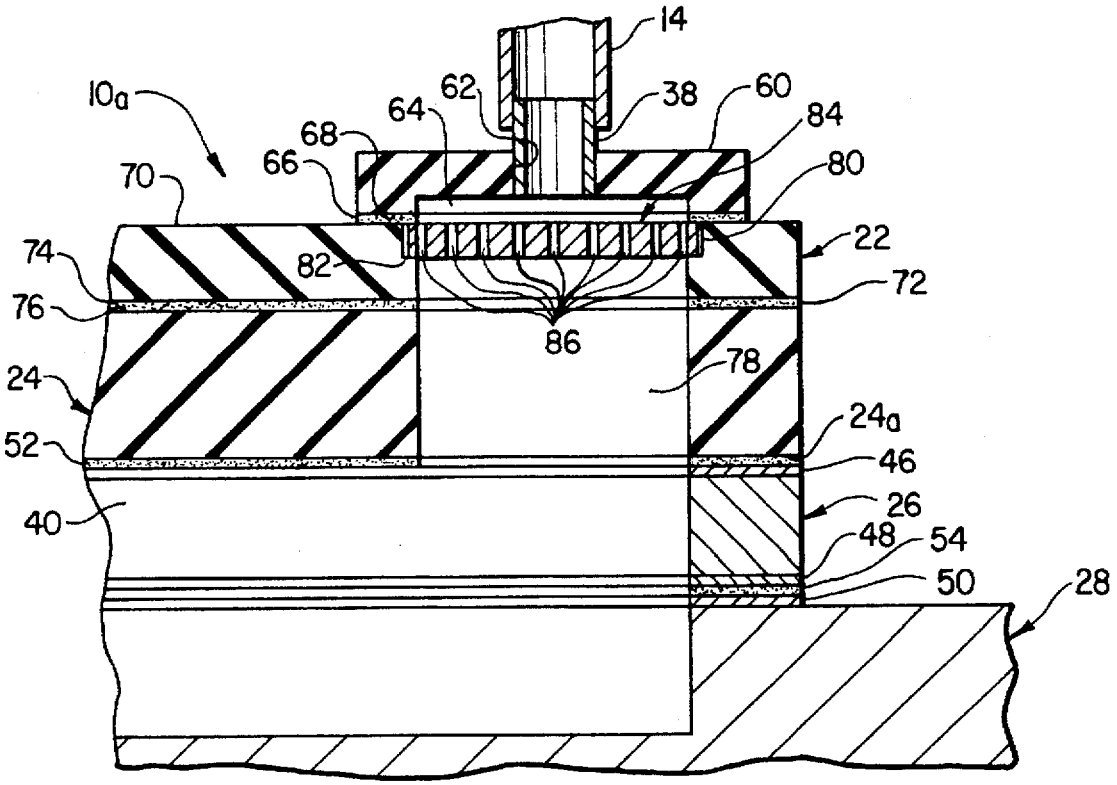
FIG. 4 is an enlarged scale partial cross-sectional view through another embodiment of the printhead taken along line 3—3 of FIG. 1 showing a filter cavity and a drop-in etched filter within the printhead that is in communication with the ink conduit and the ink manifold channel in communication with the internal ink receiving channels.

FIG. 4 illustrates yet another embodiment 10*a* of the printhead wherein the internal filter is a separate component that is positioned in an internal filter cavity. Formed integrally through top body section 22, which may be comprised of an ablateable nonpolled ceramic material, such as a photoetchable glass material, is a filter cavity 80. The filter cavity 80 extends through section 22 from the top side surface 70 to the bottom side surface 74. Formed within the filter cavity 80 is an upwardly facing ledge 82 for receiving a removable separate filter structure 84. In communication with the filter cavity 80 is an ink manifold cavity 78. As previously discussed, the ink manifold cavity 78 is in communication with the ink receiving channels 40 through which the ink passes to the ink discharge orifices 20 (see FIG. 1).

The separate filter structure 84 is comprised of a plurality of vertically extending, horizontally spaced micro filter passageways 86 integrally formed in the material comprising the separate filter structure 84. The micro filter passageways 86 receive ink from the external ink supply source (not shown) through the ink conduit 14 that is attached to the conduit member 38.

The filter cavity 80 may be integrally formed within the top section 22 by conventional methods or may be formed by the photoetching process previously discussed, provided that the top section 22 is comprised of a photosensitive etchable material. Once the filter cavity 80 has been formed, the separate filter structure 84 may be supported within the filter cavity 80 by the upwardly facing ledge 82. It is important to note that the filter structure 84 is not formed from the top section 22 but is, instead, a separate component. The bottom side surface 68 of the cover plate 60 may also include the previously mentioned recessed area 64 formed therein that allows the ink to uniformly pass through the filter structure 84.

In the printhead embodiment 10*a* illustrated in FIG. 4, the filter structure 84 is preferably comprised of a photoetchable glass material in which the micro filter passageways 86 are formed therein by means of the photoetching process previously described. However, if so desired, the micro filter passageways 86 may also be formed by an ablation process using a laser or an ion beam.

The ink manifold cavity 78, the internal ink receiving channels 40 and the ink discharge orifices (not shown) may be formed by the same conventional methods as previously mentioned.

Figure 5:
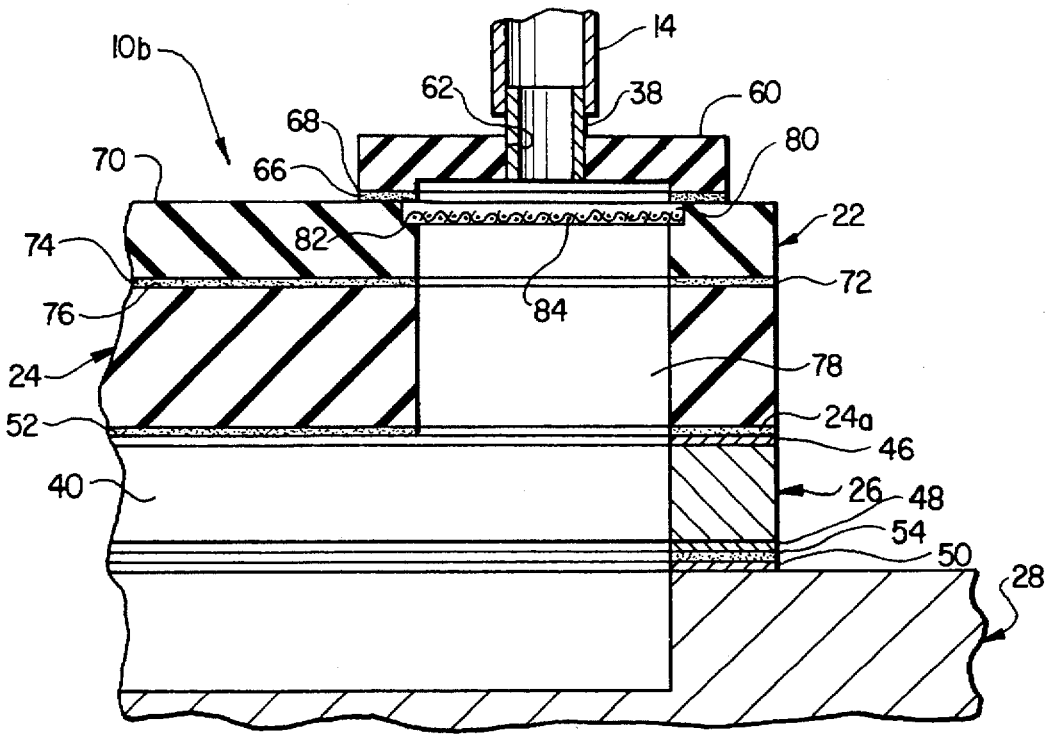
FIG. 5 is an enlarged scale partial cross-sectional view through another embodiment of the printhead taken along line 3—3 of FIG. 1 showing a micro mesh screen filter structure within the printhead in communication with the ink conduit and the ink manifold channel in communication with the internal ink receiving channels.

Turning now to FIG. 5, there is illustrated yet another embodiment 10*b* of the ink jet printhead of the present invention. In this particular embodiment, the printhead 10*b* has an integral filter cavity 80 formed within the top section 22 with an upwardly facing ledge 82 for receiving and supporting a removable separate conventional mesh-type micro filter member 84. The filter cavity 80 may be formed in the same manner as previously described in the embodiment illustrated in FIG. 4.

Figure 6:
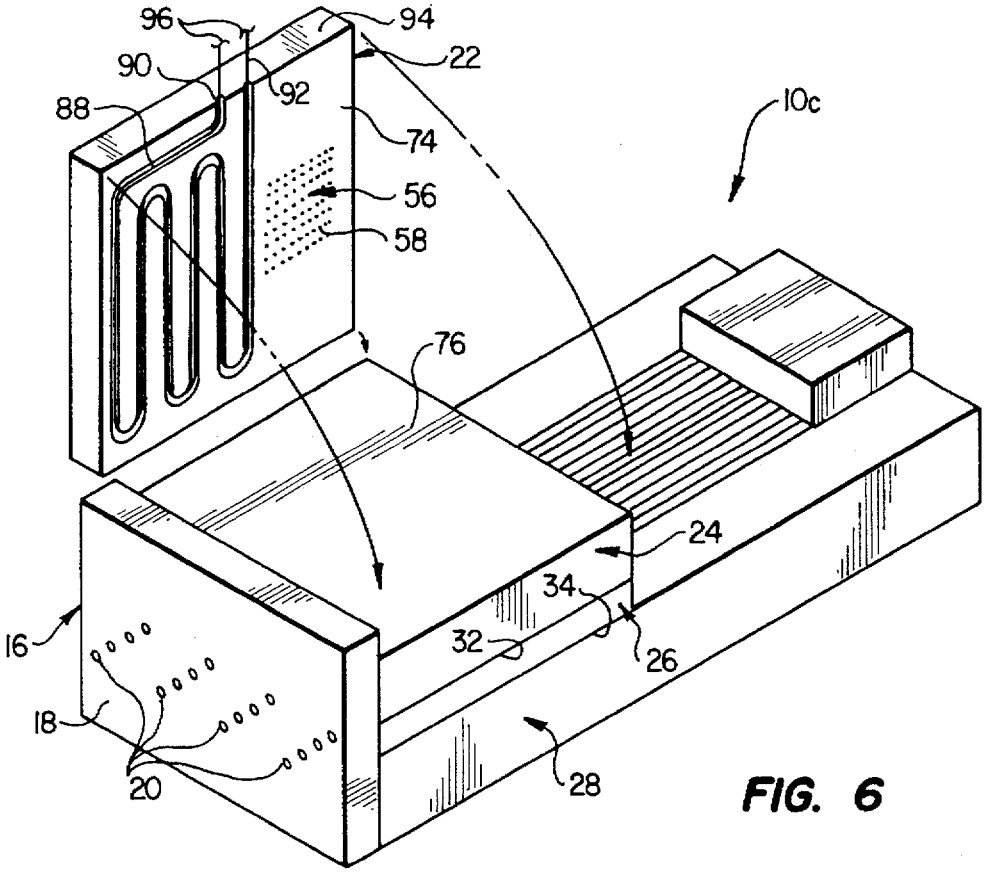
FIG. 6 is a partially exploded perspective view of a further alternate embodiment of the printhead illustrating an internal heating channel and element, and internal micro filter passageways within the printhead.

Presented in FIG. 6 is yet another unique embodiment 10*c* of a printhead having both an internal filter and a heating channel that is essential when using phase change inks that are of a wax-like consistency at room temperatures. The printhead 10*c* has a top section 22 with an internal heating channel 88 for heating phase change inks that are wax-like at room temperature. The internal heating channel 88 has an inlet opening 90 and an outlet opening 92 formed within the side edge portion 94 of the top section 22 and has a predetermined depth for receiving an electrical resistance heating wire 96 positioned therein for heating the printhead 10*c*. The depth of the heating channel 88 is sufficient to receive the heating wire 96 so that the top section 22 can lay flat on the first intermediate section 24 without interference from the heating wire 96. The heating wire 96 may be conventional resistance wire used for electrical heating purposes and is positioned in the heating channel 88 so that the opposite ends of the heating wire 96 may be connected to an external power source. While FIG. 6 illustrates the wires extending outwardly from the top section 22 through the inlet and outlet openings 90 and 92, it should be understood that other conventional means may be used to connect the heating wire 96 to an appropriate power source (not shown).

The heating channel 88 may be integrally formed in the bottom surface side 74 of the top section 22 through the same ablation processes discussed above for the filter cavity and micro filter passageways. Alternatively, however, it should be recognized that the heating channel 88 may be integrally formed in the top side surface 76 of the first intermediate section 24 by the same processes. When ablation methods such as cutting by saw, drilling or cutting by laser are used, the material need only be made of a nonpolled ablate ceramic material.

Preferably, however, the channel is formed by the photoetching process, and the selected section in which the heating channel 88 is to be formed is comprised of a photosensitive etchable glass. When the selected section is made of this preferable material, the heating channel 88 may be formed by the same photoetching process as previously described above for forming the micro filter passageways. The bottom portion 74 of the top section 22 is masked to expose the desired channel pattern. Alternatively, when it is desired to form the heating channel 88 in the top surface 76 of the first intermediate section 24, the top surface 76 is masked to expose the desired channel pattern. The selected masked portion 74 or 76 is then exposed to ultraviolet rays. The exposed pattern is then crystallized through the heating process, after which, the crystallized portion is dissolved by hydrofluoric acid.

In another aspect of this particular embodiment, the printhead can include various embodiments of an internal filter structure as described above. Preferably, however, the filter structure 56 is comprised of vertically extending, horizontally spaced micro filter passageways 58, and more preferably, the micro filter passageways 58 are integrally formed in the top section 22 in the same manner as previously discussed concerning the embodiment illustrated in FIG. 3. However, if so desired, the filter structure may also be a separate filter structure that can be placed into an internal filter cavity formed from the top section as discussed above for the embodiment illustrated in FIG. 4.

The present embodiment offers manufacturing and cost saying advantage over other prior art devices. First, when the top section 22 is comprised of photosensitive etchable glass, the heating channel 88 and the micro filter passageways 58, or filter cavity, depending on the embodiment, can be formed simultaneously. For example, the top section 22 from which both the heating channel 88 and the micro filter passageways 58 are formed can be masked so as to expose the desired heating channel and micro filter passageway pattern simultaneously. With one exposure to the ultraviolet rays and one exposure to the subsequent heat treatment, the desired heating channel 88 and micro filter passageways 58 are crystallized. The hydrofluoric acid can be applied simultaneously to the crystallized portions of both the heating channel and the micro filter passageways. Thus several manufacturing steps are saved. This, of course, reduces the overall cost of the printhead. Second, because the heating element is located internally within the printhead, there is a more efficient distribution of heat that allows the printhead to be heated with less power. In conventional printhead heating systems, the heating element is located on the outside of the printhead. Thus, when the printhead is heated, enough energy must be applied to heat the internal ink distribution passageways of the printhead from the outside; this configuration requires more energy. In contrast, the present invention provides an internal heating channel that is in closer proximity to the internal ink distribution passageways. This closer proximity requires less energy to maintain the ink at the appropriate flowing temperature. Third, because the heating channel is positioned internally within the printhead, it is less susceptible to damage.

The foregoing detailed description is to be clearly understood as being given by way of illustration and example only, the spirit and scope of the present invention being limited solely by the appended claims.

What is claimed is:

1. An ink jet printhead comprising:

a body having a top section, a bottom section and an intermediate section, said top section, said bottom section, and said intermediate section being parallel, intersecured and generally plate-like, with each section having a top side surface, a bottom side surface and aligned front edge surfaces;

an ink supply source;

an ink conduit;

means for filtering ink, interiorly disposed within said top section, said ink filter means communicating with said ink supply source through said ink conduit, said ink conduit extending between said ink filter means and said ink supply source;

an ink manifold cavity formed within said body and being in fluid communication with said ink filter means;

a front end section joined to said top section, intermediate section and bottom section along said aligned front edge surfaces thereof, said front end section having a spaced series of ink discharge orifices extending rearwardly therethrough;

a spaced, parallel series of internal deflectable sidewall sections extending rearwardly through said body from said front end section thereof and laterally bounding a spaced series of internal ink receiving channels interdigitated with said sidewall sections and opening outwardly through said discharge orifices, said receiving channels being in fluid communication with said ink manifold cavity to receive an ink flow therefrom;

said top section being made of a photosensitive etchable glass material and including a heating channel integrally formed in said bottom side surface of said top section proximate each of said internal ink receiving channels;

a heating element for heating said body disposed within said heating channel; and a cover section sealingly secured to said top side surface of said top section over said ink filter means, said cover section having a conduit member positioned therein in fluid communication with said ink filter means for receiving ink from the ink conduit.

2. An ink jet printhead comprising:

a body having a top section, a bottom section and an intermediate section, said top section, said bottom section, and said intermediate section being parallel, intersecured and generally plate-like, with each section having a top side surface, a bottom side surface and aligned front edge surfaces;

an ink supply source;

an ink conduit;

means for filtering ink, interiorly disposed within said top section, said ink filter means communicating with said ink supply source through said ink conduit, said ink conduit extending between said ink filter means and said ink supply source;

said top section being made of a photosensitive etchable glass material and said filter means including a plurality of photoetched micro filter passageways integrally formed through said top section;

an ink manifold cavity formed within said body and being in fluid communication with said ink filter means;

a front end section joined to said top section, intermediate section and bottom section along said aligned front edge surfaces thereof, said front end section having a spaced series of ink discharge orifices extending rearwardly therethrough;

a spaced, parallel series of internal deflectable sidewall sections extending rearwardly through said body from said front end section thereof and laterally bounding a spaced series of internal ink receiving channels interdigitated with said sidewall sections and opening outwardly through said discharge orifices, said receiving channels being in fluid communication with said ink manifold cavity to receive an ink flow therefrom; and a cover section sealingly secured to said top side surface of said top section over said ink filter means, said cover section having a conduit member positioned therein in fluid communication with said ink filter means for receiving ink from the ink conduit.

3. An ink jet printhead comprising:

a body having a top section, a bottom section and an intermediate section, said top section, said bottom section, and said intermediate section being parallel, intersecured and generally plate-like, with each section having a top side surface, a bottom side surface and aligned front edge surfaces;

an ink supply source;

an ink conduit;

means for filtering ink, interiorly disposed within said top section, said ink filter means communicating with said ink supply source through said ink conduit, said ink conduit extending between said ink filter means and said ink supply source;

said ink filter means comprising a filter cavity formed in said top body section and a separate filter structure received in said filter cavity, said separate filter structure being made of a photosensitive etchable glass material having a plurality of photoetched micro passageways formed therein;

an ink manifold cavity formed within said body and being in fluid communication with said ink filter means;

a front end section joined to said top section, intermediate section and bottom section along said aligned front edge surfaces thereof, said front end section having a spaced series of ink discharge orifices extending rearwardly therethrough;

a spaced, parallel series of internal deflectable sidewall sections extending rearwardly through said body from said front end section thereof and laterally bounding a spaced series of internal ink receiving channels interdigitated with said sidewall sections and opening outwardly through said discharge orifices, said receiving channels being in fluid communication with said ink manifold cavity to receive an ink flow therefrom; and a cover section sealingly secured to said top side surface of said top section over said ink filter means said cover section having a conduit member positioned therein in fluid communication with said ink filter means for receiving ink from the ink conduit.

4. An ink jet printhead comprising:

a body having a top section, a bottom section and an intermediate section, said top section, said bottom section, and said intermediate section being parallel, intersecured and generally plate-like, with each section having a top side surface, a bottom side surface and aligned front edge surfaces, said body further comprising heating means, disposed within said body, for heating said body, said heating means including a heating channel formed interiorly within, and integral with, said body and an electrical resistance heating wire positioned within said heating channel;

an ink supply source;

an ink conduit:

means for filtering ink, interiorly disposed within said top section, said ink filter means communicating with said ink supply source through said ink conduit, said ink conduit extending between said ink filter means and said ink supply source;

an ink manifold cavity formed within said body and being in fluid communication with said ink filter means, said heating means being isolated from fluid communication with said ink manifold cavity;

a front end section joined to said top section, intermediate section and bottom section along said aligned front edge surfaces thereof, said front end section having a spaced series of ink discharge orifices extending rearwardly therethrough;

a spaced, parallel series of internal deflectable sidewall sections extending rearwardly through said body from said front end section thereof and laterally bounding a spaced series of internal ink receiving channels interdigitated with said sidewall sections and opening outwardly through said discharge orifices, said receiving channels being in fluid communication with said ink manifold cavity to receive an ink flow therefrom; and a cover section sealingly secured to said top side surface of said top section over said ink filter means, said cover section having a conduit member positioned therein in fluid communication with said ink filter means for receiving ink from the ink conduit.

5. The printhead of claim 4 wherein said intermediate section is comprised of a first intermediate portion secured along a first juncture area to a second intermediate portion, said first intermediate portion being secured to said top section along a second juncture area and said second intermediate portion being secured to said bottom section along a third juncture area.

6. An ink jet printhead comprising:

a body having a top section, a bottom section and an intermediate section, said top section, said bottom section, and said intermediate section being parallel, intersecured and generally plate-like, with each section having a top side surface, a bottom side surface and aligned front edge surfaces;

said body including means, disposed within said body, for heating said body, said heating means including a heating channel formed interiorly within said body and an electrical resistance heating wire positioned within said heating channel;

said top section being made of a photosensitive etchable glass material and said heating channel being integrally formed in said bottom side surface of said top section;

said intermediate section being comprised of a first intermediate portion secured along a first juncture area to a second intermediate portion, said first intermediate portion being secured to said top section along a second juncture area and said second intermediate portion being secured to said bottom section along a third juncture area;

an ink supply source;

an ink conduit;

means for filtering ink, interiorly disposed within said top section, said ink filter means communication with said ink supply source through said ink conduit, said ink conduit extending between said ink filter means and said ink supply source;

an ink manifold cavity formed within the interior of said body and being in fluid communication with said ink filter means;

a front end section joined to said top section, intermediate section and bottom section along said aligned front edge surfaces thereof, said front end section having a spaced series of ink discharge orifices extending rearwardly therethrough;

a spaced, parallel series of internal deflectable sidewall sections extending rearwardly through said body from said front end section thereof and laterally bounding a spaced series of internal ink receiving channels interdigitated with said sidewall sections and opening outwardly through said discharge orifices, said receiving channels being in fluid communication with said ink manifold cavity to receive an ink flow therefrom; and a cover section sealingly secured to said top side surface of said top section over said ink filter means, said cover section having a conduit member positioned therein in fluid communication with said ink filter means for receiving ink from the ink conduit.

7. An ink jet printhead comprising:

a body having a top section, a bottom section and an intermediate section, said top section, said bottom section, and said intermediate section being parallel, intersecured and generally plate-like, with each section having a top side surface, a bottom side surface and aligned front edge surfaces;

said body including means, disposed within said body, for heating said body, said heating means including a heating channel formed interiorly within said body and an electrical resistance heating wire positioned within said heating channel;

said intermediate section being comprised of a first intermediate portion secured along a first juncture area to a second intermediate portion, said first intermediate portion having a top surface and being secured to said top section along a second juncture area and said second intermediate portion being secured to said bottom section along a third juncture area, said first intermediate portion being made of a photosensitive etchable glass material and said heating channel being integrally formed in said top side surface of said first intermediate portion;

an ink supply source;

an ink conduit;

means for filtering ink, interiorly disposed within said top section, said ink filter means communicating with said ink supply source through said ink conduit, said ink conduit extending between said ink filter means and said ink supply source;

an ink manifold cavity formed within said body and being in fluid communication with said ink filter means;

a front end section joined to said top section, intermediate section and bottom section along said aligned front edge surfaces thereof, said front end section having a spaced series of ink discharge orifices extending rearwardly therethrough;

a spaced, parallel series of internal deflectable sidewall sections extending rearwardly through said body from said front end section thereof and laterally bounding a spaced series of internal ink receiving channels interdigitated with said sidewall sections and opening outwardly through said discharge orifices, said receiving channels being in fluid communication with said ink manifold cavity to receive an ink flow therefrom; and a cover section sealingly secured to said top side surface of said top section over said ink filter means, said cover section having a conduit member positioned therein in fluid communication with said ink filter means for receiving ink from the ink conduit.

8. An ink jet printhead comprising:

a body having a top section, a bottom section and an intermediate section, said top section, said bottom section, and said intermediate section being parallel, intersecured and generally plate-like, with each section having a top side surface, a bottom side surface and aligned front edge surfaces;

an ink supply source;

an ink conduit:

a filter cavity, integrally formed in said body, having a separate filter structure, said filter cavity communicating with said ink supply source through said ink conduit, said ink conduit extending between said ink filter cavity and the ink supply source;

said separate ink filter structure removably disposed within said filter cavity;

an ink manifold cavity formed within said body and being in fluid communication with said ink filter cavity;

a front end section joined to said top section, intermediate section and bottom section along said aligned front edge surfaces thereof, said front end section having a spaced series of ink discharge orifices extending rearwardly therethrough;

a spaced, parallel series of internal piezoelectric deflectable sidewall sections extending rearwardly through said body from said front end section thereof and laterally bounding a spaced series of internal ink receiving channels interdigitated with said sidewall sections and opening outwardly through said discharge orifices, said receiving channels being in fluid communication with said ink manifold cavity to receive an ink flow therefrom;

said top section being made of a photosensitive etchable glass material and including a heating channel integrally formed in said bottom side surface of said top section proximate each of said internal ink receiving channels;

a heating element for heating said body disposed within said heating channel; and a cover section sealingly secured to said top side surface of said top section over said ink filter cavity, said cover section having a conduit member positioned therein in fluid communication with said ink filter structure for receiving ink from the ink conduit.

9. An ink jet printhead comprising:

a body having a top section, a bottom section and an intermediate section, said top section, said bottom section, and said intermediate section being parallel, intersecured and generally plate-like, with each section having a top side surface, a bottom side surface and aligned front edge surfaces;

an ink supply source;

an ink conduit:

a filter cavity, integrally formed in said body, having a separate filter structure, said filter cavity communicating with said ink supply source through said ink conduit, said ink conduit extending between said ink filter cavity and the ink supply source;

said separate ink filter structure removably disposed within said filter cavity, said separate ink filter structure being comprised of a photosensitive etchable glass material having a plurality of photoetched micro passageways formed therein;

an ink manifold cavity formed within said body and being in fluid communication with said ink filter cavity;

a front end section joined to said top section, intermediate section and bottom section along said aligned front edge surfaces thereof, said front end section having a spaced series of ink discharge orifices extending rearwardly therethrough;

a spaced, parallel series of internal piezoelectric deflectable sidewall sections extending rearwardly through said body from said front end section thereof and laterally bounding a spaced series of internal ink receiving channels interdigitated with said sidewall sections and opening outwardly through said discharge orifices, said receiving channels being in fluid communication with said ink manifold cavity to receive an ink flow therefrom; and a cover section scalingly secured to said top side surface of said top section over said ink filter cavity, said cover section having a conduit member positioned therein in fluid communication with said ink filter structure for receiving ink from the ink conduit.

10. An ink jet printhead comprising:

a body having a top section, a bottom section and an intermediate section, said top section, said bottom section, and said intermediate section being parallel, intersecured and generally plate-like, with each section having a top side surface, a bottom side surface and aligned front edge surfaces, said top section being made of a photosensitive etchable glass material;

an ink supply source;

an ink conduit;

a filter cavity, integrally formed in said body, having a separate filter structure, said filter cavity communicating with said ink supply source through said ink conduit, said ink conduit extending between said ink filter cavity and the ink supply source;

said separate ink filter structure removably disposed within said filter cavity, said separate ink filter structure being comprised of a micro mesh metal screen;

an ink manifold cavity formed within said body and being in fluid communication with said ink filter cavity;

a front end section joined to said top section, intermediate section and bottom section along said aligned front edge surfaces thereof, said front end section having a spaced series of ink discharge orifices extending rearwardly therethrough;

a spaced, parallel series of internal piezoelectric deflectable sidewall sections extending rearwardly through said body from said front end section thereof and laterally bounding a spaced series of internal ink receiving channels interdigitated with said sidewall sections and opening outwardly through said discharge orifices, said receiving channels being in fluid communication with said ink manifold cavity to receive an ink flow therefrom; and a cover section sealingly secured to said top side surface of said top section over said ink filter cavity, said cover section having a conduit member positioned therein in fluid communication with said ink filter structure for receiving ink from the ink conduit.

11. An ink jet printhead comprising:

a body having a top section, a bottom section and an intermediate section, said top section, said bottom section, and said intermediate section being parallel, intersecured and generally plate-like, with each section having a top side surface, a bottom side surface and aligned front edge surfaces, said body further comprising a heating means disposed within said body for heating said body, wherein said heating means is comprised of a heating channel formed interiorly within, and integral with, said body and an electrical conductive resistance wire positioned within said heating channel;

an ink supply source:

an ink conduit;

a filter cavity, integrally formed in said body, having a separate filter structure, said filter cavity communicating with said ink supply source through said ink conduit, said ink conduit extending between said ink filter cavity and the ink supply source;

said separate ink filter structure removably disposed within said filter cavity;

an ink manifold cavity formed within said body and being in fluid communication with said ink filler cavity, said heating means being isolated from fluid communication with said ink manifold cavity;

a front end section joined to said top section, intermediate section and bottom section along sand aligned front edge surfaces thereof, said front end section having a spaced series of ink discharge orifices extending rearwardly therethrough;

a spaced, parallel series of internal piezoelectric deflectable sidewall sections extending rearwardly through said body from said front end section thereof and laterally bounding a spaced series of internal ink receiving channels interdigitated with said sidewall sections and opening outwardly through said discharge orifices, said receiving channels being in fluid communication with said ink manifold cavity to receive an ink flow therefrom; and a cover section sealingly secured to said top side surface of said top section over said ink filter cavity, said cover section having a conduit member positioned therein in fluid communication with said ink filter structure for receiving ink from the ink conduit.

12. The printhead of claim 11 wherein said vertically intermediate section is comprised of a first intermediate section securely joined along a first juncture area to a second intermediate section, said first intermediate section being securely joined to said top section along a second juncture area and said second intermediate section being securely joined to said bottom section along a third juncture area.

13. An ink jet printhead comprising:

a body having a top section, a bottom section and an intermediate section, said top section, said bottom section, and said intermediate section being parallel, intersecured and generally plate-like, with each section having a top side surface, a bottom side surface and aligned front edge surfaces;

said body further comprising a heating means, disposed within said body, for heating said body, said heating means comprising a heating channel formed interiorly within said body and an electrical conductive resistance wire positioned within said heating channel;

said top section being made of a photosensitive etchable glass material and said heating channel being integrally formed in said bottom side surface of said top section;

said intermediate section comprising a first intermediate portion securely joined along a first juncture area to a second intermediate portion, said first intermediate portion being securely joined to said top section along a second juncture area and said second intermediate portion being securely joined to said bottom section along a third juncture area;

an ink supply source;

an ink conduit;

a filter cavity, integrally formed in said body, having a separate filter structure, said filter cavity communicating with said ink supply source through said ink conduit, said ink conduit extending between said ink filter cavity and the ink supply source;

said separate ink filter structure removably disposed within said filter cavity;

an ink manifold cavity formed within said body and being in fluid communication with said ink filter cavity;

a front end section joined to said top section, intermediate section and bottom section along said aligned front edge surfaces thereof, said front end section having a spaced series of ink discharge orifices extending rearwardly therethrough;

a spaced, parallel series of internal piezoelectric deflectable sidewall sections extending rearwardly through said body from said front end section thereof and laterally bounding a spaced series of internal ink receiving channels interdigitated with said sidewall sections and opening outwardly through said discharge orifices, said receiving channels being in fluid communication with said ink manifold cavity to receive an ink flow therefrom; and a cover section sealingly secured to said top side surface of said top section over said ink filter cavity, said cover section having a conduit member positioned therein in fluid communication with said ink filter structure for receiving ink from the ink conduit.

14. An ink jet printhead comprising:

a body having a top section, a bottom section and an intermediate section, said top section, said bottom section, and said intermediate section being parallel, intersecured and generally plate-like, with each section having a top side surface, a bottom side surface and aligned front edge surfaces;

said body further comprising a heating means, disposed within said body, for heating said body, said heating means comprising a heating channel formed interiorly within said body and an electrical conductive resistance wire positioned within said heating channel;

said intermediate section being made of a photosensitive etchable glass material and said heating channel being integrally formed in said top side surface of said intermediate section;

said intermediate section comprising a first intermediate portion securely joined along a first juncture area to a second intermediate portion, said first intermediate portion being securely joined to said top section along a second juncture area and said second intermediate portion being securely joined to said bottom section along a third juncture area;

an ink supply source;

an ink conduit;

a filter cavity, integrally formed in said body, having a separate filter structure, said filter cavity communicating with said ink supply source through said ink conduit, said ink conduit extending between said ink filter cavity and the ink supply source;

said separate ink filter structure removably disposed within said filter cavity;

an ink manifold cavity formed within said body and being in fluid communication with said ink filter cavity;

a front end section joined to said top section, intermediate section and bottom section along said aligned front edge surfaces thereof, said front end section having a spaced series of ink discharge orifices extending rearwardly therethrough;

a spaced, parallel series of internal piezoelectric deflectable sidewall sections extending rearwardly through said body from said front end section thereof and laterally bounding a spaced series of internal ink receiving channels interdigitated with said sidewall sections and opening outwardly through said discharge orifices, said receiving channels being in fluid communication with said ink manifold cavity to receive an ink flow therefrom; and a cover section sealingly, secured to said top side surface of said top section over said ink filter cavity, said cover section having a conduit member positioned therein in fluid communication with said ink filter structure for receiving ink from the ink conduit.

15. An ink jet printhead comprising:

a body having a first outer side surface and second outer side surface, said first outer side surface being made of a photosensitive etchable glass material;

an ink supply, source;

an ink conduit;

means for filtering ink, recessed into said first outer side surface, said ink filter means communicating with said ink supply source through said ink conduit, said ink conduit extending between said ink filter means and the ink supply source;

an orifice plate secured to said second outer side surface, said orifice plate having a spaced series of ink discharge orifices extending rearwardly therethrough;

a spaced, parallel series of internal deflectable sidewall sections extending rearwardly through said body from said orifice plate thereof and laterally bounding a spaced series of internal ink receiving channels interdigitated with said sidewall sections and opening outwardly through said discharge orifices, said ink receiving channels being in fluid communication with said ink filter means to receive an ink flow therefrom; and a cover section sealingly secured to said first outer side surface over said ink filter means, said cover section having a conduit member positioned therein in fluid communication with said ink filter means for receiving ink from the ink conduit.

16. An ink jet printhead comprising:

a body having a first outer side surface and second outer side surface;

an ink supply source;

an ink conduit;

means for filtering ink, recessed into said first outer side surface, said ink filter means communicating with said ink supply source through said ink conduit, said ink conduit extending between said ink filter means and the ink supply source, said ink filter means comprising a filter cavity integrally formed in said first outer side surface for receiving a separate filter structure;

said separate filter structure being made of a photosensitive etchable glass having a plurality of photoetched micro passageways formed therein;

an orifice plate secured to said second outer side surface, said orifice plate having a spaced series of ink discharge orifices extending rearwardly therethrough;

a spaced, parallel series of internal deflectable sidewall sections extending rearwardly through said body from said orifice plate thereof and laterally bounding a spaced series of internal ink receiving channels interdigitated with said sidewall sections and opening outwardly through said discharge orifices, said ink receiving channels being in fluid communication with said ink filter means to receive an ink flow therefrom; and a cover section sealingly secured to said first outer side surface over said ink filter means, said cover section having a conduit member positioned therein in fluid communication with said ink filter means for receiving ink from the ink conduit.

17. An ink jet printhead comprising:

a body having a first outer side surface and second outer side surface, said first outer side surface being made of a photosensitive etchable glass material;

an ink supply source;

an ink conduit:

means for filtering ink, recessed into said first outer side surface, said ink filter means communicating with said ink supply source through said ink conduit, said ink conduit extending between said ink filter means and the ink supply source, said ink filter means comprising a filter cavity photoetched in said first outer side surface receiving a removable filter structure;

said separate filter structure being made of a micro mesh screen having a plurality of micro passageways formed therein;

an orifice plate secured to said second outer side surface, said orifice plate having a spaced series of ink discharge orifices extending rearwardly therethrough;

a spaced, parallel series of internal deflectable sidewall sections extending rearwardly through said body from said orifice plate thereof and laterally bounding a spaced series of internal ink receiving channels interdigitated with said sidewall sections and opening outwardly through said discharge orifices, said ink receiving channels being in fluid communication with said ink filter means to receive an ink flow therefrom; and a cover section sealingly secured to said first outer side surface over said ink filter means, said cover section having a conduit member positioned therein in fluid communication with said ink filter means for receiving ink from the ink conduit.

18. An ink jet printhead comprising:

a body having a first outer side surface and second outer side surface;

an ink supply source;

an ink conduit;

means for filtering ink, recessed into said first outer side surface, said ink filter means communicating with said ink supply source through said ink conduit, said ink conduit extending between said ink filter means and the ink supply source;

an orifice plate secured to said second outer side surface, said orifice plate having a spaced series of ink discharge orifices extending rearwardly therethrough;

a spaced, parallel series of internal deflectable sidewall sections extending rearwardly through said body from said orifice plate thereof and laterally bounding a spaced series of internal ink receiving channels interdigitated with said sidewall sections and opening outwardly through said discharge orifices, said ink receiving channels being in fluid communication with said ink filter means to receive an ink flow therefrom;

said first outer side surface being made of a photosensitive etchable glass material and including a heating channel formed interiorly within, and integral with, said first outer side surface proximate each of said internal ink receiving channels;

a heating element for heating said body disposed within said heating channel; and a cover section sealingly secured to said first outer side surface over said ink filter means, said cover section having a conduit member positioned therein in fluid communication with said ink filter means for receiving ink from the ink conduit.

19. An ink jet printhead comprising:

a body having a first outer side surface and second outer side surface, said body further comprising heating means, formed interiorly within, and integral with, said body, for heating said body, said heating means including a heating channel formed interiorly within said body and an electrical conductive resistance wire positioned within said heating channel;

an ink supply source;

an ink conduit;

means for filtering ink, recessed into said first outer side surface, said ink filter means communicating with said ink supply source through said ink conduit, said ink conduit extending between said ink filter means and the ink supply source;

an orifice plate secured to said second outer side surface, said orifice plate having a spaced series of ink discharge orifices extending rearwardly therethrough;

a spaced, parallel series of internal deflectable sidewall sections extending rearwardly through said body from said orifice plate thereof and laterally bounding a spaced series of internal ink receiving channels interdigitated with said sidewall sections and opening outwardly through said discharge orifices, said ink receiving channels being in fluid communication with said ink filter means to receive an ink flow therefrom; and a cover section sealingly secured to said first outer side surface over said ink filter means, said cover section having a conduit member positioned therein in fluid communication with said ink filter means for receiving ink from the ink conduit.

20. An ink jet printhead comprising:

a body having a top section, a bottom section and an intermediate section, said top section, said bottom section, and said intermediate section being parallel, intersecured and generally plate-like, with each section having a top side surface, a bottom side surface and aligned front edge surfaces;

an ink supply:

an ink filter;

an ink manifold cavity formed within said body and being in fluid communication with said ink supply and said ink filter, said ink filter being disposed in said intermediate section;

a front end section joined to said top section, intermediate section and bottom section along said aligned front edge surfaces thereof, said front end section having a spaced series of ink discharge orifices extending rearwardly therethrough;

a spaced, parallel series of internal deflectable sidewall sections extending rearwardly through said body from said front end section thereof and laterally bounding a spaced series of internal ink receiving channels interdigitated with said sidewall sections and opening outwardly through said discharge orifices, said receiving channels being in fluid communication with said ink manifold cavity to receive an ink flow therefrom;

said top section being made of a photosensitive etchable glass material and including a heating channel integrally formed in said bottom side surface of said top section proximate each of said internal ink receiving channels; and a heating element for heating said body disposed within said heating channel.

21. The printhead of claim 20 wherein said intermediate section includes a first intermediate portion secured along a first juncture area to a second intermediate portion, said first intermediate portion being secured to said top section along a second juncture area and said second intermediate portion being secured to said bottom section along a third juncture area.

22. An ink jet printhead comprising:

a body having a top section, a bottom section and an intermediate section, said top section, said bottom section, and said intermediate section being parallel, intersecured and generally plate-like, with each section having a top side surface, a bottom side surface and aligned front edge surfaces;

heating means, disposed within said body, for heating said body, said heating means including a photoetched channel integrally formed in said bottom side surface of said top section and an electrical conductive resistance wire positioned therein;

an ink supply;

an ink filter;

an ink manifold cavity formed within said body and being in fluid communication with said ink supply and said ink filter, said ink filter being disposed in said intermediate section;

a front end section joined to said top section, intermediate section and bottom section along said aligned front edge surfaces thereof, said front end section having a spaced series of ink discharge orifices extending rearwardly therethrough; and a spaced, parallel series of internal deflectable sidewall sections extending rearwardly through said body from said front end section thereof and laterally bounding a spaced series of internal ink receiving channels interdigitated with said sidewall sections and opening outwardly through said discharge orifices, said receiving channels being in fluid communication with said ink manifold cavity to receive an ink flow therefrom.

23. An ink jet printhead comprising:

a body having a top section, a bottom section and an intermediate section, said top section, said bottom section, and said intermediate section being parallel, intersecured and generally plate-like, with each section having a top side surface, a bottom side surface and aligned front edge surfaces;

said intermediate section including a first intermediate portion secured along a first juncture area to a second intermediate portion, said first intermediate portion being secured to said top section along a second juncture area and said second intermediate portion being secured to said bottom section along a third juncture area;

heating means, disposed within said body, for heating said body, said heating means including a heating channel integrally;

said top section being made of a photosensitive etchable glass material and said heating channel being integrally formed in said bottom side surface of said top section receiving an electrical conductive resistance wire therein;

an ink supply;

an ink filter;

an ink manifold cavity formed within said body and being in fluid communication with said ink supply and said ink filter, said ink filter being disposed in said intermediate section;

a front end section joined to said top section, intermediate section and bottom section along said aligned front edge surfaces thereof, said front end section having a spaced series of ink discharge orifices extending rearwardly therethrough; and a spaced, parallel series of internal deflectable sidewall sections extending rearwardly through said body from said front end section thereof and laterally bounding a spaced series of internal ink receiving channels interdigitated with said sidewall sections and opening outwardly through said discharge orifices, said receiving channels being in fluid communication with said ink manifold cavity to receive an ink flow therefrom.

24. An ink jet printhead comprising:

a body having a top section, a bottom section and an intermediate section, said top section, said bottom section, and said intermediate section being parallel, intersecured and generally plate-like, with each section having a top side surface, a bottom side surface and aligned front edge surfaces;

said intermediate section including a first intermediate portion secured along a first juncture area to a second intermediate portion, said first intermediate portion having a top surface and being secured to said top section along a second juncture area and said second intermediate portion being secured to said bottom section along a third juncture area;

heating means, disposed within said body, for heating said body, said heating means including a heating channel;

said first intermediate portion being made of a photosensitive etchable glass material and said heating channel being integrally formed in said top side surface of said first intermediate portion receiving an electrical conductive resistance wire therein;

an ink supply;

an ink filter;

an ink manifold cavity formed within said body and being in fluid communication with said ink supply and said ink filter, said ink filter being disposed in said intermediate section;

a front end section joined to said top section, intermediate section and bottom section along said aligned front edge surfaces thereof, said front end section having a spaced series of ink discharge orifices extending rearwardly therethrough; and a spaced, parallel series of internal deflectable sidewall sections extending rearwardly through said body from said front end section thereof and laterally bounding a spaced series of internal ink receiving channels interdigitated with said sidewall sections and opening outwardly through said discharge orifices, said receiving channels being in fluid communication with said ink manifold cavity to receive an ink flow therefrom.

25. An ink jet printhead comprising:

a body having a top section, a bottom section and an intermediate section, said top section, said bottom section, and said intermediate section being parallel, intersecured and generally plate-like, with each section having a top side surface, a bottom side surface and aligned front edge surfaces;

an ink supply source;

an ink conduit;

means for filtering ink, interiorly disposed within said top section, said ink filter means communicating with said ink supply source through said ink conduit, said ink conduit extending between said ink filter means and said ink supply source;

an ink manifold cavity formed within said body and being in fluid communication with said ink filter means;

a front end section joined to said top section, intermediate section and bottom section along said aligned front edge surfaces thereof, said front end section having a spaced series of ink discharge orifices extending rearwardly therethrough;

a spaced, parallel series of internal deflectable sidewall sections extending rearwardly through said body from said front end section thereof and laterally bounding a spaced series of internal ink receiving channels interdigitated with said sidewall sections and opening outwardly through said discharge orifices, said receiving channels being in fluid communication with said ink manifold cavity to receive an ink flow therefrom;

said intermediate section including a first intermediate portion secured along a first juncture area to a second intermediate portion, said first intermediate portion being secured to said top section along a second juncture area and said second intermediate portion being secured to said bottom section along a third juncture area, said first intermediate portion being made of a photosensitive etchable glass material and including a heating channel integrally formed in said top side surface of said first intermediate portion proximate each of said internal ink receiving channels;

a heating element for heating said body disposed within said heating channel; and a cover section sealingly secured to said top side surface of said top section over said ink filter means, said cover section having a conduit member positioned therein in fluid communication with said ink filter means for receiving ink from the ink conduit.

26. An ink jet printhead comprising:

a body having a top section, a bottom section and an intermediate section, said top section, said bottom section, and said intermediate section being parallel, intersecured and generally plate-like, with each section having a top side surface, a bottom side surface and aligned front edge surfaces;

an ink supply surface;

an ink conduit:

a filter cavity, integrally formed in said body, having a separate filter structure, said filter cavity communicating with said ink supply source through said ink conduit, said ink conduit extending between said ink filter cavity and the ink supply source;

said separate ink filter structure removably disposed within said filter cavity;

an ink manifold cavity formed within said body and being in fluid communication with said ink filter cavity;

a front end section joined to said top section, intermediate section and bottom section along said aligned front edge surfaces thereof, said front end section having a spaced series of ink discharge orifices extending rearwardly therethrough;

a spaced, parallel series of internal deflectable sidewall sections extending rearwardly through said body from said front end section thereof and laterally bounding a spaced series of internal ink receiving channels interdigitated with said sidewall sections and opening outwardly through said discharge orifices, said receiving channels being in fluid communication with said ink manifold cavity to receive an ink flow therefrom;

said intermediate section including a first intermediate portion secured along a first juncture area to a second intermediate portion, said first intermediate portion being secured to said top section along a second juncture area and said second intermediate portion being secured to said bottom section along a third juncture area, said first intermediate portion being made of a photosensitive etchable glass material and including a heating channel integrally formed in said top side surface of said first intermediate portion proximate each of said internal ink receiving channels;

a heating element for heating said body disposed within said heating channel; and a cover section sealingly secured to said top side surface of said top section over said ink filter cavity, said cover section having a conduit member positioned therein in fluid communication with said ink filter structure for receiving ink from the ink conduit.

27. An ink jet printhead comprising:

a body having a top section, a bottom section and an intermediate section, said top section, said bottom section, and said intermediate section being parallel, intersecured and generally plate-like, with each section having a top side surface, a bottom side surface and aligned front edge surfaces;

an ink supply;

an ink filter;

an ink manifold cavity formed within said body and being in fluid communication with said ink supply and said ink filter, said ink filter being disposed in said intermediate section;

a front end section joined to said top section, intermediate section and bottom section along said aligned front edge surfaces thereof, said front end section having a spaced series of ink discharge orifices extending rearwardly therethrough; and a spaced, parallel series of internal deflectable sidewall sections extending rearwardly through said body from said front end section thereof and laterally bounding a spaced series of internal ink receiving channels interdigitated with said sidewall sections and opening outwardly through said discharge orifices, said receiving channels being in fluid communication with said ink manifold cavity to receive an ink flow therefrom;

said intermediate section including a first intermediate portion secured along a first juncture area to a second intermediate portion, said first intermediate portion being secured to said top section along a second juncture area and said second intermediate portion being secured to said bottom section along a third juncture area, said first intermediate portion being made of photosensitive etchable glass material and including a heating channel integrally formed in said top side surface of said first intermediate portion proximate each of said internal ink receiving channels; and a heating element for heating said body disposed within said heating channel.

* * * * *